US005603639A

United States Patent [19]

Lai et al.

[11] Patent Number: 5,603,639

[45] Date of Patent: Feb. 18, 1997

[54] SHIELDED ELECTRICAL CONNECTOR

[75] Inventors: Chin-Te Lai, Taipei Hsien, Taiwan; Tim S. L. Chang, Chino Hills, Calif.

[73] Assignee: Genrife Company Limited, Queensway, Hong Kong

[21] Appl. No.: 520,775

[22] Filed: Aug. 30, 1995

[51] Int. Cl.[6] ..... H01R 13/648

[52] U.S. Cl. ..... 439/607; 439/353

[58] Field of Search ..... 439/607–610, 439/108, 353

[56] References Cited

U.S. PATENT DOCUMENTS

| | | | |
|---|---|---|---|
| 5,147,220 | 9/1992 | Lybrand | 439/607 |
| 5,228,873 | 7/1993 | Hirai | 439/573 |
| 5,288,244 | 2/1994 | Lien | 439/607 |
| 5,401,189 | 3/1995 | Sato | 439/607 |

*Primary Examiner*—Hien Vu

*Attorney, Agent, or Firm*—Cushman Darby & Cushman Intellectual Property Group Pillsbury Madison & Sutro LLP

[57] ABSTRACT

A shielded electrical connector comprises a connector body, a pair of nut screws, a pair of clamp piece, and a shielding cover. The connector body has a longitudinally-shaped body and has formed on the its center a connector head assembly. The connector head assembly having a number of signal pins aligned within the confinement thereof, and the connector body has formed on each end of the longitudinal body a clamp piece receiving section. Each of the sections has four receiving surfaces with the second receiving surface parallel to the surface of the connector body. The pair of nut screws each comprises a cylindrical body and has a threaded hole formed in the hollow space inside the cylindrical body. The pair of clamp pieces each comprises a three-panel square column, and a clamp hook plate extends vertically from the edge of a second one of the panels. A shielding cover has a generally longitudinal-shaped body and has formed on its center a shielding wall. Each of the pair of nut screws is installed inside a corresponding one the opening on one of the receiving surfaces, each of the clamp pieces is slid into the enclosing position surrounding a corresponding one the clamp piece receiving sections, and the shielding cover is aligned and joined with the connector body.

5 Claims, 3 Drawing Sheets

SHIELDED ELECTRICAL CONNECTOR

BACKGROUND OF THE INVENTION

1. Field of the Invention

The present invention relates in general to a shielded electrical connector. In particular, the present invention relates to a shielded electrical connector that provides improved shielding effectiveness to the electrical signals connected therethrough. More particularly, the present invention relates to a shielded electrical connector that provides effective shielding while is easy to control the manufacturing quality and cost thereof.

2. Technical Background

Shielded electrical connectors are widely utilized in digital computing devices for providing the connection paths for a multiple of digital signals that require shielding. One category of electrical signal connectors conveying a multiple of signals at once by providing a number of the type of pin and socket match-contacting pairs is the connector commonly referred to as the D-type connectors. A D-type connector has a number of either male pins of female sockets aligned in two or three rows that are surrounded by a shielding metal plate exhibiting the shape of a character "D" when viewed from the end of the shielded connector.

In general, the shielding of such connectors has at least three purposes. First of all, the digital signals connected via the shielded connector may be required not to generate electro-magnetic interference (EMI) signals to the surrounding environment. For example, a poorly, or unshielded D-type connector conveying tens of digital signals in a house computer may generate radio-frequency EMI to the radio receiver or television set near by. Secondly, the digital signals may themselves require not to be interfered by EMI of the surrounding environment. For example, a poorly or un-shielded D-type connector found in the computer systems operating in severe environments such as in a factory having abundant sources of EMI may have the signals conveyed therein interfered- And, last of all, the connection points in the connector for each of the conveyed signals usually require tight physical shielding against dust and moist.

To better understand the disclosure of the present invention, a brief review of the conventional shielded electrical connector follows to show the technical background. FIG. 1 is an exploded perspective view of a conventional shielded electrical connector. As is seen in the drawing, the shielded D-type electrical connector is generally comprised of a shielding cover 31 made of suitable metal material, a connector body 20 that provides the connecting means for the conveyed multiple of signals, and a pair of clamp blocks 23.

The shielding cover 31 is substantially a long-shaped piece of metal plate made by, for example, press-forming or casting. An elongated opening is surrounded by the shielding wall 35 that allows for the contacting access of the multiple of connecting means when the connector is to be used by mating with the other electrical connector. Two smaller narrow and long clamp hook openings 33 are each formed at one side of the shielding wall 35. Each of the pair of clamp hook opening 33 may receive the insertion of the clamping portion of the clamp block 23 when the entire shielded electrical connector is assembled. Two screw holes 32 are each formed at the exterior sides of the clamp hook openings 33, as is seen in the drawing. These screw holes 32 may provide for the installation of screws to assist in securing the entire assembling of the electrical connector. A pair of clamp slots 36 may each be formed on the upper and lower edges of the shielding cover 31. They provide for the clamping by the connector body 20 when the entire shielded electrical connector is assembled together.

The connector body 20 also has a substantially elongated shape as is seen in the drawing. A connector head assembly 22 protrudes out of the connector body 20 which has enclosed within its generally hollow space a number of signal connecting means, for example, the contact pins 24 in this exemplified male connector. At both longitudinal ends of the connector body 20, there is formed one clamp block hole 25 for housing the clamp block 23 when the connector is assembled. To receive and contain the clamp block 23 in a fixed and secure manner, the ends of the connector body 20 formed with the clamp block hole 25 is shaped to have the stop edge 46 at the opposite end of the opening of the hole 25, a long slot 40 at the opposite side walls of the connector body 20, as well as the arc-shaped slot 42 on the upper and lower surfaces of the connector body 20. The formation of the stop edge 46, the long slot 40 and the arc-shaped slot 42 is for fixedly containing the clamp block 23 once it is installed in the clamp block hole 25 by matching the correspondingly shaped portions of the clamp block 23. At the upper and lower edges of the connector body 20, there are provided the clamping protrusions 34 that may clamp the connector body 20 to the shielding cover 31 by inserting into the corresponding clamp slots 36.

The clamp block 23 is basically a block with a clamping hook 26 made of electrically conducting material. The use of electrically conducting material allows the clamp block 23 to constitute one section of the grounding path of the shielding of the electrical connector. The main body of the clamp block 23 has a recessed opening 41 at the opposite end of the hook 26, a pair of elevated portions 46 on the top and bottom surfaces of the main body, and a threaded hole 45 formed at the end where the hook 26 extends from the main body. One positioning hole 43 is formed in each of the elevated portions 46, including the portions 46 on the top and bottom surfaces.

When the constituting components of the conventional shielded electrical connector is assembled together, each of the pair of the clamp blocks 23 is inserted into their corresponding clamp block hole 25 of the connector body 20. When either of the clamp blocks 23 is correctly inserted into the clamp block hole 25, the main body of the clamp block 23 will be entirely buried therein, with the clamping hook 26 extending out of the surface of the main body of the connector body 20. The elevated portions 46 on both the top and bottom surfaces of the clamp block 23 will be placed in the arc-shaped slot 42 of the connector body 20 in a matched manner, while the stop edges 46 of the connector body 20 will prevent the clamp block 23 from backing off. On the other hand, the elevated portions 46 also serve to restrict the movement of the clamp block 23 toward the direction of the hook 26.

Then, the shielding cover 31 may be assembled by allowing the pair of clamping hooks 26 of the clamp blocks 23 now each installed in the corresponding clamp block hole 25 of the connector body 20 to pass through the clamp hook opening 33. This is done by aligning the connector body 20 and the shielding cover 31 and joining both together. When the two are correctly combined, the connector head assembly 22 of the connector body 20 would be installed surroundedly by the shielding wall 35 of the shielding cover 31. Meanwhile, the clamping hooks 26 now extending out of the clamp block holes 25 at both sides of the head connector assembly 22 would also extend out of the corresponding clamp hook opening 33. The screw holes 32 of the shielding cover 31 would now also be aligned with the threaded hole 45 of the clamp blocks 23. This allows the for use of screws to secure the four components, namely the shielding cover 31, the connector body 20, and each of the clamp blocks 23, tightly together.

Now, the assembled shielded electrical connector may be installed to the edge of a printed circuit board 28 that has fabricated thereon the electronic circuitries to be connected to the shielding electric connector. When the shielding electrical connector is installed to the printed circuit board 28, the edge of the circuit board is slid into the open space provided by the recessed opening 41 formed at one end of the clamp block 23, as well as the open space provided by the long slot 40 formed on the sidewall of the connector body 20. If the shielded electrical connector is correctly placed in the position on the printed circuit board 28, the positioning holes 43 formed on the clamp blocks 23 at both sides of the connector itself would be aligned with the corresponding positioning holes 48 formed on the printed circuit board 28. Means such as long pins or screws may then be employed to secure the shielded electrical connector at the proper location on the printed circuit board 28.

This type of conventional shielded electrical connectors is intended to provide both the functionality of signal shielding as well as ground path establishment. When one such connector installed to the edge of a printed circuit board is connected with a corresponding male or female electrical connector similarly shielded, the static electric charge carried by the person handling the electronic system may be discharged without damaging the circuitries connected beyond the connected pins of the pair of shielded electrical connectors. The discharging electric current may be carried by the shielding covers of the connector that are properly connected to the ground path of the system. On the other hand, since the signal connector pins and sockets that are mated within the connector pair of shielded electrical connectors are properly enclosed within the shielding covers, therefore the electrical signals are well shielded away from the environmental EMI, or from generating the EMI.

This type of conventional shielded electrical connectors, however, has at least the following disadvantages. In general, in the conventional shielded electrical connectors, the establishment of the grounding path relies on the successive electrical connection between the inner surface 31' of the shielding cover 31 and the contact surface 23' of the clamp block 23. There are, however, occasions that the contact surface 23' does not come to proper contact with the inner surface 31' of the shielding cover 31 when the entire shielded electrical connector is assembled together. Most frequent reason for this missed contact along the grounding path is due to manufacturing tolerances inevitable in the making of both the connector body 20 and the clamp block 23. The only way to discard the disqualified shielded electrical connectors when they are still in the manufacturing factory is to conduct testing of the contact itself. This would incur a considerable investment of labor and time in the manufacturing process of the connectors, since a large portion would be qualified connector products.

Moreover, the use of screw to secure the assembly of the shielded electrical connector by screwing in the threaded hole 45 of the clamp block 23 also introduces another inconvenience. Different countries employ different gauge systems for screws. To fulfill the English and metric system requirements, the clamp block 23 must be manufactured in two specifications. Two sets of press molds would be required for the clamp block, which represents increased cost for the product.

SUMMARY OF THE INVENTION

It is therefore an object of the present invention to provide a shielded electrical connector that provides improved shielding effectiveness to the electrical signals connected therethrough.

It is another object of the present invention to provide a shielded electrical connector that provides effective shielding while is easy to control the manufacturing quality and cost.

The present invention achieves the above-identified objects by providing a shielded electrical connector for providing external connection to the electrical signals of the electronic circuitries on a printed circuit board. The shielded electrical connector comprises a connector body, a pair of nut screws, a pair of clamp piece, and a shielding cover. The connector body has a longitudinally-shaped body and has formed on the its center a connector head assembly. The connector head assembly has a number of signal pins aligned within the confinement thereof, and the connector body has formed on each of both ends of the longitudinal body a clamp piece receiving section. Each of the sections has four receiving surfaces with the second receiving surface parallel to the surface of the connector body where the connector head assembly extends. The first and third receiving surfaces are vertical to the second receiving surface and opposing each other. The second receiving surface has formed therein an opening, and the fourth receiving surface is opposing the first receiving surface and has formed therein a recessed slot for receiving the PCB. Each of the pair of nut screws comprises a cylindrical body and has a threaded hole formed in the hollow space inside the cylindrical body. Each of the pair of clamp pieces comprises a three-panel square column, and a clamp hook plate extends vertically from the edge of a second one of the panels. Each of the first and third panels is opposed but also parallel to each other, and is connected at one edge thereof to one edge of the second panel. The second panel has formed thereon a screw opening. A shielding cover has a generally longitudinal-shaped body and has formed on its center a shielding wall. Each of the pair of clamp hook opening is located at one exterior side of the shielding wall, and each of a pair of screw holes is located at one further exterior side of the clamp hook openings. Each of the pair of nut screws is installed inside a corresponding one the opening on the second receiving surface, each of the clamp pieces is slid into the enclosing position surrounding a corresponding one the clamp piece receiving sections, and the shielding cover is aligned and joined with the connector body.

The present invention further achieves the above-identified objects by providing a shielded electrical connector wherein the first and/or the third panels further has a resilient arm extending at the edge of the first and/or third panels in the direction the clamp hook plate extends out of the second panel. The resilient arm has a length allowing the free end thereof to extend slightly out of the surface of the second panel in the direction of extension.

The present invention further achieves the above-identified objects by providing a shielded electrical connector wherein a protruding portion is formed at the end of the clamp hook plate connecting the second panel of the clamp pieces. The protruding portion raises above the surface of the clamp hook plate toward the other opposing end of the second panel. The extent of the raised height of the protruding portion above the surface is set to the level that when the shielding cover is assembled, the edge of the clamp hook opening opposing the clamp hook plate contacts the protruding portion.

BRIEF DESCRIPTION OF THE DRAWING

Other objects, features, and advantages of the present invention will become apparent by way of the following detailed description of the preferred but non-limiting embodiments. The description is made with reference to the accompanied drawings in which.

DETAILED DESCRIPTION OF THE PREFERRED EMBODIMENT

Figure 1:
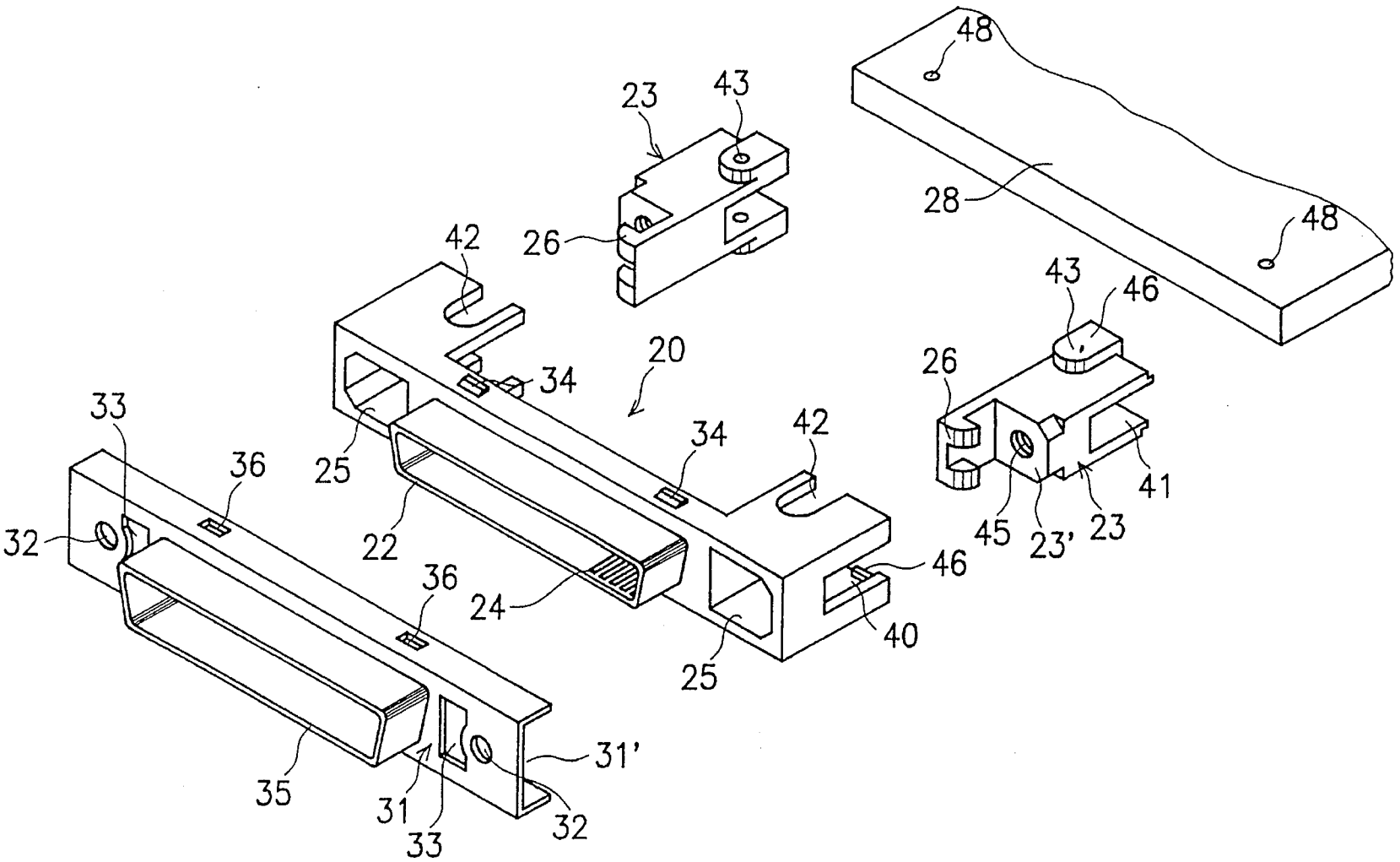
FIG. 1 (PRIOR ART)
FIG. 1 is an exploded perspective view of a conventional shielded electrical connector.

It should be noted that the same reference numerals are utilized to denote the same or similar parts in all the drawings for the description of the embodiments of the present invention.

Figure 2:
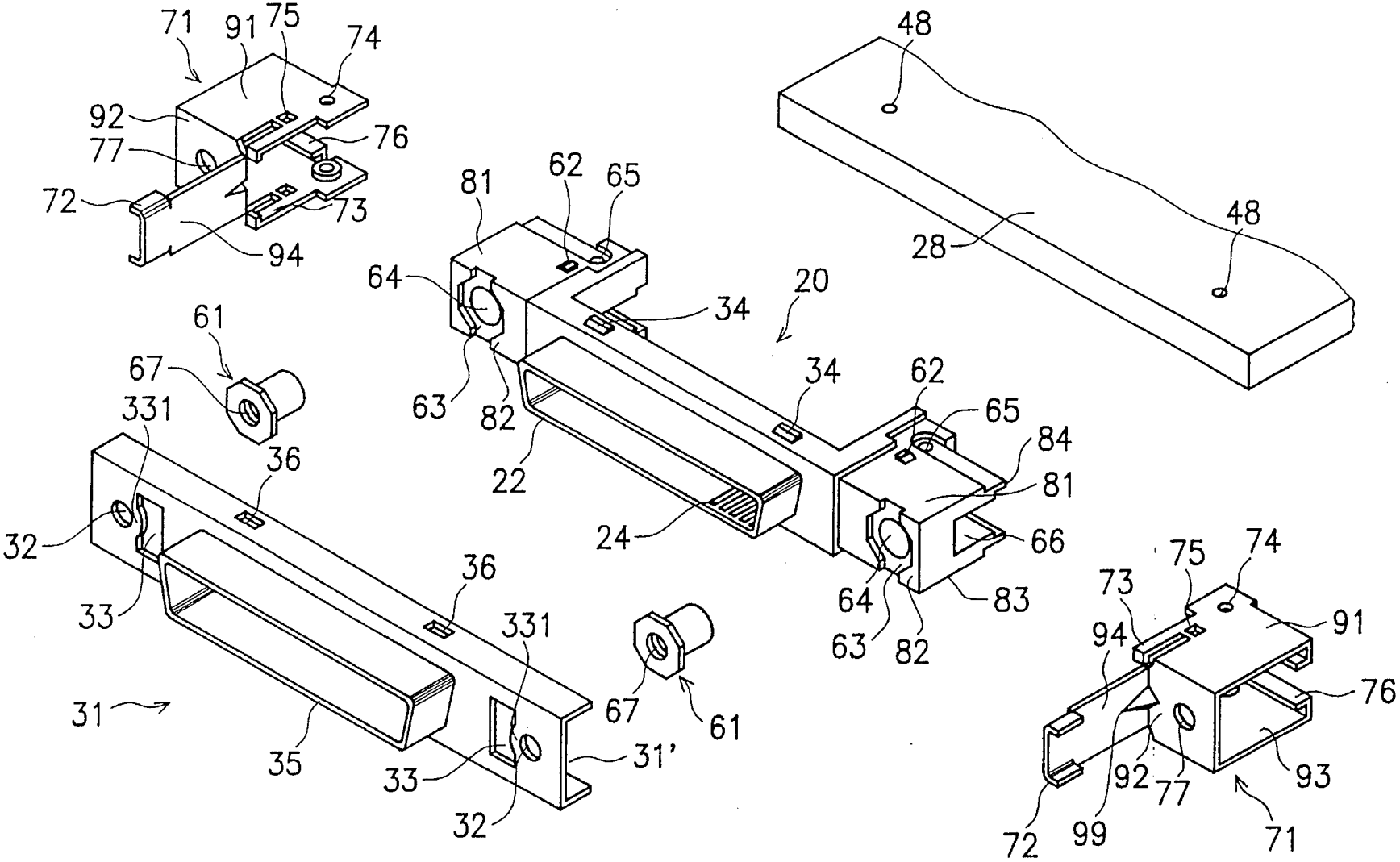
FIG. 2 is an exploded perspective view of a the shielded electrical connector in accordance with a preferred embodiment of the present invention.

Refer to FIG. 2 of the drawing, wherein an exploded perspective view of a the shielded electrical connector in accordance with a preferred embodiment of the present invention is shown. As is seen in the drawing, the shielded electrical connector of the preferred embodiment of the present invention comprises a connector body 20, a shielding cover 31, a pair of screw nuts 61, and a pair of clamp pieces 71.

As was described above in the review of the conventional shielded electrical connector, the shielding cover 31 is a substantially long-shaped piece of metal plate made by press-forming or casting. An elongated opening is surrounded by the shielding wall 35 that allow for the contacting access of the multiple of connecting means when the connector is to be used by mating with the other electrical connector. Two smaller narrow and long clamp hook openings 33 are each formed at one side of the shielding wall 35. Each of the pair of clamp hook opening 33 may receive the insertion of the clamping portion, that is, the clamp hook 72 of the clamp piece 71 when the entire shielded electrical connector is assembled. Two screw holes 32 are each formed at the exterior sides of the clamp hook openings 33. These screw holes 32 provide for the installation of screws to secure the entire assembling of the subject shielded electrical connector. Each of a pair of clamp slots 36 is formed on the upper and lower edges of the shielding cover 31. As was in the case of the conventional shielded electrical connectors, they provide for the clamping by the connector body 20 when the entire electrical connector is assembled together.

The connector body 20 has a substantially elongated shape in the drawing. A connector head assembly 22 protrudes out of the connector body 20 which has enclosed within its generally hollow space a number of signal connecting means, for example, the contact pins 24 in this exemplified male connector of the preferred embodiment of the present invention. As persons skilled in the art would well appreciate, the connecting means may also be the female sockets, and either the pins and sockets may be aligned in, for example, two or three rows.

At both longitudinal ends of the connector body 20, there is each provided a clamp piece receiving section having the first, second, third and fourth receiving surfaces 81, 82, 83 and 84 respectively, as is shown in the drawing. The first and third receiving surfaces 81 and 83 are each located at the top and bottom surfaces of the connector body 20 respectively, while the second receiving surface 82 is at the same surface that the connector head assembly 22 protrudes out of the connector body 20. The fourth receiving surface 84, on the other hand, is at the opposite side of the third receiving surface 83.

There is provided on the second receiving surface 82 a recessed plane 63 with an opening 64 located at substantially the center position thereof. At the opposite surface of the second receiving surface 82, namely the fourth receiving surface 84, there is provided a recessed slot 66 having a longitudinal direction parallel to the longitudinal axis of the connector body 20. The opening 64 is generally a cylindrical channel starting at the second receiving surface 82 and ends at the bottom of the recessed slot 66 at the fourth receiving surface 84 on the opposite end. In other words, the opening 64 may penetrate directly through the clamp piece receiving section of the connector body 20.

The first and third receiving surfaces of the clamp piece receiving section of the connector body 20 has substantially the same configuration, although in mutual mirror images. Description of one surface, for example the first receiving surface 81, is therefore sufficient for the understanding of the present invention. As is seen in the drawing, there is provided on the first receiving surface 81 a positioning hole 65 and a securing protrusion 62. The positioning hole 65 is a through-hole, which means it is communicating with the recessed slot 66 with an opening on the side wall thereof.

The clamp piece 71 has a general shape of a short square column with one side panel thereof removed. As is seen in FIG. 2, the three side panels are panels 91, 92 and 93 respectively. Panels 91 and 93 are similarly configured with the only difference being the fact that they are mirror images for each other. The panel 92 serves to connect the two opposing panels 91 and 93. A screw opening 77 is formed generally in the center area of the panel 92. A clamp hook plate 94 extends vertically out of the panel 93 at the edge thereof. The clamp hook plate 94 has clamping edges 72 bent out of the surface of the plate 94 itself at its far end. At the other end of the clamp hook plate 94 where the plate 94 connects the panel 92, a protruding portion 99 is formed. The protruding portion 99 serves to help maintain the clamp hook plate 94 at its vertically extending orientation with respect to the panel 92. Each of the two opposing panels 91 and 93 has a positioning hole 74 and a clamping hole 75 formed thereon, as well as a resilient arm 73 extending at the edge of the panels 91 and 93 in the direction the clamp hook plate 94 extends out of the panel 92. The length of the resilient arm 73 allows the free tip end thereof to extend slightly out of the surface of the panel 92 in the direction of its extension. At the opposite direction, on the other hand, the edge of the panel 91 and 93 is bent back over to form the clamping edge 76 as is observed in the drawing.

When the constituting components of the shielded electrical connector as exemplified by the embodiment of the present invention as depicted in FIG. 2 is assembled together, each of the pair of screw nuts 61 is first inserted into the opening 64 of the connector body 20. Each of the pair of screw nuts 61 is a type of screw nut having a polygonal head plate attached to one end of its generally cylindrical body. A threaded hole 67 is formed in the center of hollow space along the longitudinal axis thereof. The diameter of the cylindrical body of the screw nut 61 is selected to allow for its smooth insertion into the opening 64 of the connector body 20 with reasonable tolerance between its exterior surface and the interior surface of the opening 64. The polygonal head plate of the screw nut 61, on the other hand, is allowed to be placed into the recessed plane 63 of the connector body 20 entirely, with its polygonal periphery matching the corresponding side wall of the recessed plane 63 that prevent the screw nut 61 from rotating around its longitudinal axis once inserted properly in place in the opening 64.

Then, each of the ends of the connector body 20, that is, the clamp piece receiving section is slidingly inserted into their corresponding one of the pair of the clamp pieces 71. When either of the clamp pieces 71 is correctly in place at the corresponding end of the connector body 20, the securing protrusion 62 of the first receiving surface 81 of the clamp piece receiving section will perfectly extend into the open space of the clamping hole 75 on the panel 91 of clamp piece 71. It should be noted that there is another matched pair of securing protrusion 62 and clamping hole 75 on the bottom side of the connector body 20, although not seen in the drawing.

Meanwhile, the screw opening 77 of the panel 92 would be aligned properly with the opening 64 of the connector body 20, with the screw nut 61 already placed in the proper location in the opening 64. On the other end, the positioning holes 74 on both the panel 91 and 93 are each aligned with the corresponding positioning hole 65 on the first receiving surfaces 81 and 83 respectively. Further, the ends of the receiving surfaces 81 and 83 of the clamp piece receiving section of the connector body 20 would each extend into the slot formed by the bent back over of the clamping edge 76 of the end edges of the panels 91 and 93 respectively.

Then, the shielding cover 31 may be assembled by allowing the pair of clamp hook plate 94 of the clamp piece 71 now each installed on the clamp piece receiving section of the connector body 20 to pass through the clamp hook opening 33. This is done by aligning the connector body 20 and the shielding cover 31 and joining them together. When the two are correctly combined, the connector head assembly 22 Of the connector body 20 would be installed surroundedly by the shielding wall 35 of the shielding cover 31. Meanwhile, the clamp hook plate 94 now extending out of the panel 92 of the clamp piece 71 at both sides of the head connector assembly 22 would also extend out of the corresponding clamp hook opening 33. The screw holes 32 of the shielding cover 31 would now also be aligned with the threaded hole 67 of the nut screw 61. This allows the for the use of screws to secure all the constituent components of the shielded electrical connector of the present invention, namely the shielding cover 31, the connector body 20, each of the clamp piece 71, together with the pair of nut screws 61, tightly together.

Figure 3:
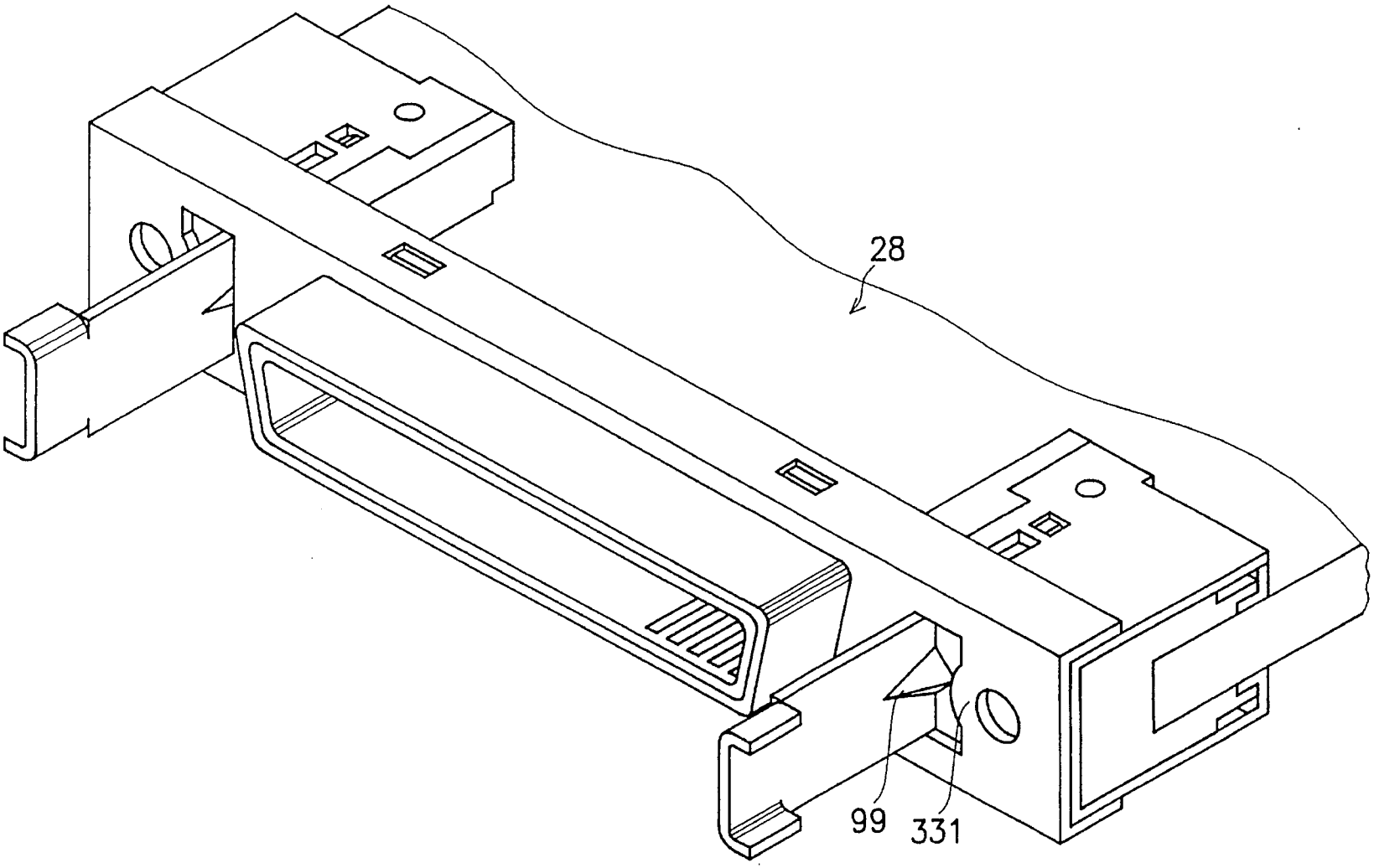
FIG. 3 is a perspective view showing the shielded electrical connector in accordance with the preferred embodiment of the present invention as assembled to the edge of a printed circuit board.

FIG. 3 is a perspective view showing the shielded electrical connector in accordance with the preferred embodiment of the present invention as assembled, and installed to the edge of a printed circuit board 28. As is seen in the drawing, the assembled shielded electrical connector may be installed to the edge of a printed circuit board 28 that has fabricated thereon the electric circuitries to be connected to the shielding electric connector. When the entire piece of the assembled shielding electrical connector is installed to the printed circuit board 28, the edge of the circuit board is slid into the open space provided by the recessed slot 66 formed at each ends of the clamp piece receiving section of the connector body 20, as enclosed by the corresponding clamp piece 71. If the shielded electrical connector is correctly placed in the position on the printed circuit board 28, the positioning holes 74 revealed on the clamp piece 71 at both sides of the connector itself would be aligned with the corresponding positioning holes 48 formed on the printed circuit board 28. Means such as long pins or screws may then be employed to secure the shielded electrical connector of the present invention at the proper location on the printed circuit board 28.

The shielded electrical connector of the present invention as exemplified in the preferred embodiment described above has the advantage of improved establishment of the grounding path. This is achieved by the presence of the resilient arms 73 of each of the clamp piece 71 on both ends of the shielded electrical connector. Since, as was described above, the tip of the end of each of the resilient arm 73 extends slightly out of the surface of the panel 92 in the direction of its extension, therefore, when the entire shielded electrical connector of the present invention is properly assembled, the tip of the resilient arms 73 would be pressed against the inner surface 31' of the shielding cover 31. This ensures the establishment of the grounding path from the shielding cover 31 to the clamp piece 71, even when certain component or components of the shielded electrical connector are slightly out of alignment due to manufacturing tolerances. The resilient nature of the resilient arm 73 allows itself to be bent when pressed against the inner surface 31' of the shielding cover 31.

On the other end, an additional measure to ensure the electrical contact between the shielding cover 31 and the clamp piece 71 may be implemented easily. Specifically, the extent of the raised height of the protruding portion 99 above the surface of the clamp hook plate 94 may be set to the level that when the shielding cover 31 is assembled, the edge 331 of the clamp hook opening 33 opposing the clamp hook plate 94 would contact the protruding portion 99. The protruding portion 99 is formed in the shape of the declining ridge as shown in the drawing, with the height thereof declining toward the direction of the extension of the clamp hook plate 94. The contact between the edge 331 and the ridge line of the protruding portion 99 would be easily secured as the screws not shown in the drawing is driven into the threaded hole 67 of the nut screw 61 hidden behind the shielding cover 31, in order to securely assemble the shielded electrical connector of the present invention.

The use of the nut screw 61 is another advantage over the prior art shielded electrical connector. The screw gauge, either metric of English, can be selected by simply utilizing the nut screw with the desired gauge. On the other hand, the clamp piece 71 may be formed by the low cost press-molding process out of a metal plate.

As persons skilled in this art may well appreciate, the above description of the preferred embodiment of the present invention is employed for the description of the present invention, not for the restriction to the present invention. Modifications to the outlined embodiment of the present invention may be apparent and should be considered to be within the scope of the present invention that is recited in the claimed section that follows.

What is claimed is:

1. A shielded electrical connector for providing external connection to electrical signals of electronic circuits on a circuit board, said shielded electronic connector comprising:

a connector body having a substantially longitudinally-shaped body and having formed on a central portion thereof a connector head assembly, said connector head assembly having a plurality of signal connecting elements aligned within a confinement thereof, said connector body having formed on each of both ends of said longitudinal body a clamp piece receiving section, each of said sections having a first, second, third and fourth receiving surfaces, said second receiving surface being parallel to a surface of said connector body from which said connector head assembly extends forward, said first and third receiving surfaces being vertical to said second receiving surface and opposing each other, said second receiving surface having formed therein an opening, and said fourth receiving surface opposing said second receiving surface and having formed therein a recessed slot for receiving said printed circuit board when said shielded electrical connector is installed;

a pair of screw nuts each comprising a cylindrical body and having a threaded hole formed in a hollow space inside said cylindrical body;

a pair of clamp pieces each comprising a three-panel square column, and a clamp hook plate extending vertically from an edge of a second one of said panels, the first and third panels being opposed to and parallel with each other, each being connected at one edge thereof to one corresponding edge of said second panel, said second panel having formed thereon a screw opening; and a shielding cover having a generally longitudinal-shaped body and having formed on a center thereof a shielding wall, a pair of clamp hook openings each located at one exterior side of said shielding wall, and a pair of screw holes respectively located beside said clamp hook openings;

each of said pair of screw nuts being installed between said connector body and said shielding cover at the corresponding end, each of said clamp pieces surrounding the corresponding one of said clamp piece receiving sections, said shielding cover being aligned and joined with said connector body; wherein each of said first and third panels of one of said clamp pieces has a clamping edge formed by bending back over edges of said first and third panels for clamping an end of the corresponding receiving surface of the printed circuit board.

2. A shielded electrical connector for providing external connection to electrical signals of electronic circuits on a circuit board, said shielded electrical connector comprising:

a connector body having a substantially longitudinally-shaped body and having formed on a central portion thereof a connector head assembly, said connector head assembly having a plurality of signal connecting elements aligned within a confinement thereof, said connector body having formed on each of both ends of said longitudinal body a clamp piece receiving section, each of said sections having a first, second, third and fourth receiving surfaces, said second receiving surface being parallel to a surface of said connector body form which said connector head assembly extends forward, said first and third receiving surfaces being vertical to said second receiving surface and opposing each other, said second receiving surface having formed therein an opening, and said fourth receiving surface opposing said second receiving surface and having formed therein a recessed slot for receiving said printed circuit board when said shielded electrical connector is installed;

a pair of screw nuts each comprising a cylindrical body and having a threaded hole formed in a hollow space inside said cylindrical body;

a pair of clamp pieces each comprising a three-panel square column, and a clamp hook plate extending vertically from an edge of a second one of said panels, the first and third panels being opposed to and parallel with each other, each being connected at one edge thereof to one corresponding edge of said second panel, said second panel having formed thereon a screw opening; and a shielding cover having a generally longitudinal-shaped body and having formed on a center thereof a shielding wall, a pair of clamp hook openings each located at one exterior side of said shielding wall, and a pair of screw holes respectively located beside said clamp hook openings;

each of said pair of screw nuts being installed between said connector body and said shielding cover at the corresponding end, each of said clamp pieces surrounding the corresponding one of said clamp piece receiving sections, said shielding cover being aligned and joined with said connector body; wherein each of said screw nuts has a polygonal head plate attached to one end of said cylindrical body, and said second receiving surface has a recessed section surrounding said opening, the diameter of said cylindrical body being selected for allowing smooth insertion of said cylindrical body into said opening, said polygonal head plate being selected for allowing full reception with said recessed section.

3. The shielded electrical connector of claim 1 or 2, wherein each of said first and said third panels further has a resilient arm extending at an edge thereof in a direction in which said clamp hook plate extends out of said second panel, and said resilient arm has a length allowing a free tip end thereof to extend slightly out of a surface of said second panel.

4. The shielded electrical connector of claim 1 or 2, wherein a protruding portion is formed at an end of said clamp hook plate connecting said second panel of said clamp pieces, said protruding portion raising above a surface of said clamp hook plate toward the other opposing end of said second panel.

5. The shielded electrical connector of claim 1 or 2, wherein a protruding portion is formed at an end of said clamp hook plate that is connected to said second panel of each of said clamp pieces, said protruding portion rising above a surface of said clamp hook plate and toward the other opposing end of said second panel, a height of said protruding portion above said surface being such that when said shielding cover is assembled, said protruding portion contacts an edge of said clamp hook opening.

* * * * *